US005523144A

United States Patent [19]

Dyer, Jr.

[11] Patent Number: 5,523,144

[45] Date of Patent: * Jun. 4, 1996

[54] BEDDING STRUCTURE WITH QUILTED-IN LUMBAR SUPPORT

[75] Inventor: Charles D. Dyer, Jr., Dallas, Tex.

[73] Assignee: Valwhat Enterprises, Inc., Dallas, Tex.

[ * ] Notice: The portion of the term of this patent subsequent to Jan. 8, 2010, has been disclaimed.

[21] Appl. No.: 2,774

[22] Filed: Jan. 8, 1993

Related U.S. Application Data

[63] Continuation-in-part of Ser. No. 958,295, Oct. 7, 1992, Pat. No. 5,319,814.

[51] Int. Cl.[6] ..... B32B 3/26; A47C 27/045; A47C 31/02

[52] U.S. Cl. ..... 428/158; 5/470; 5/475; 5/478; 428/102; 428/160; 428/284; 428/253

[58] Field of Search ..... 5/464, 470, 478, 5/475, 481; 428/901, 158

[56] References Cited

U.S. PATENT DOCUMENTS

| | | | |
|---|---|---|---|
| 3,026,544 | 3/1962 | Persicke | 5/361 |
| 3,197,357 | 7/1965 | Schulpen | 428/158 |
| 4,187,566 | 2/1980 | Peterson | 5/451 |
| 4,620,337 | 11/1986 | Williams | 5/464 |
| 4,768,251 | 9/1988 | Baskent | 5/464 |
| 4,809,375 | 3/1989 | Bull | 5/465 |
| 4,879,776 | 11/1989 | Farley | 5/436 |
| 4,955,095 | 9/1990 | Gerrick | 5/446 |
| 4,955,096 | 9/1990 | Gilroy | 5/446 |
| 4,999,868 | 3/1991 | Kraft | 5/481 |
| 5,077,848 | 1/1992 | McDaniels | 5/451 |
| 5,109,559 | 5/1992 | West | 5/451 |
| 5,319,814 | 6/1994 | Dyer, Jr. | 5/464 |

*Primary Examiner*—George F. Lesmes
*Assistant Examiner*—Kathryne E. Shelborne
*Attorney, Agent, or Firm*—Robert Groover; Betty Formby

[57] ABSTRACT

A padded cover for use with a mattress which provides added postural support (as well as extra thermal insulation and padding). The padded cover includes a sheet of support material which covers essentially the full length of the mattress. This sheet of support material is stiffened over the middle part of the mattress length. Thus, this arrangement provides extra firmness under the torso, while maintaining an essentially flat upper surface. This cover structure can be retrofitted to existing mattresses. The disclosed innovations also provide improved methods for manufacturing bedding material with stable and longitudinally nonuniform postural support. For example, in the presently preferred embodiment, three layers are fed into a standard quilting machine: an upper layer of ticking, a middle layer of convoluted-foam support material, and a bottom layer of quilt backing. The support material thus is quilted between the two other layers, giving a quilted fabric that may be made into a mattress cover.

20 Claims, 3 Drawing Sheets

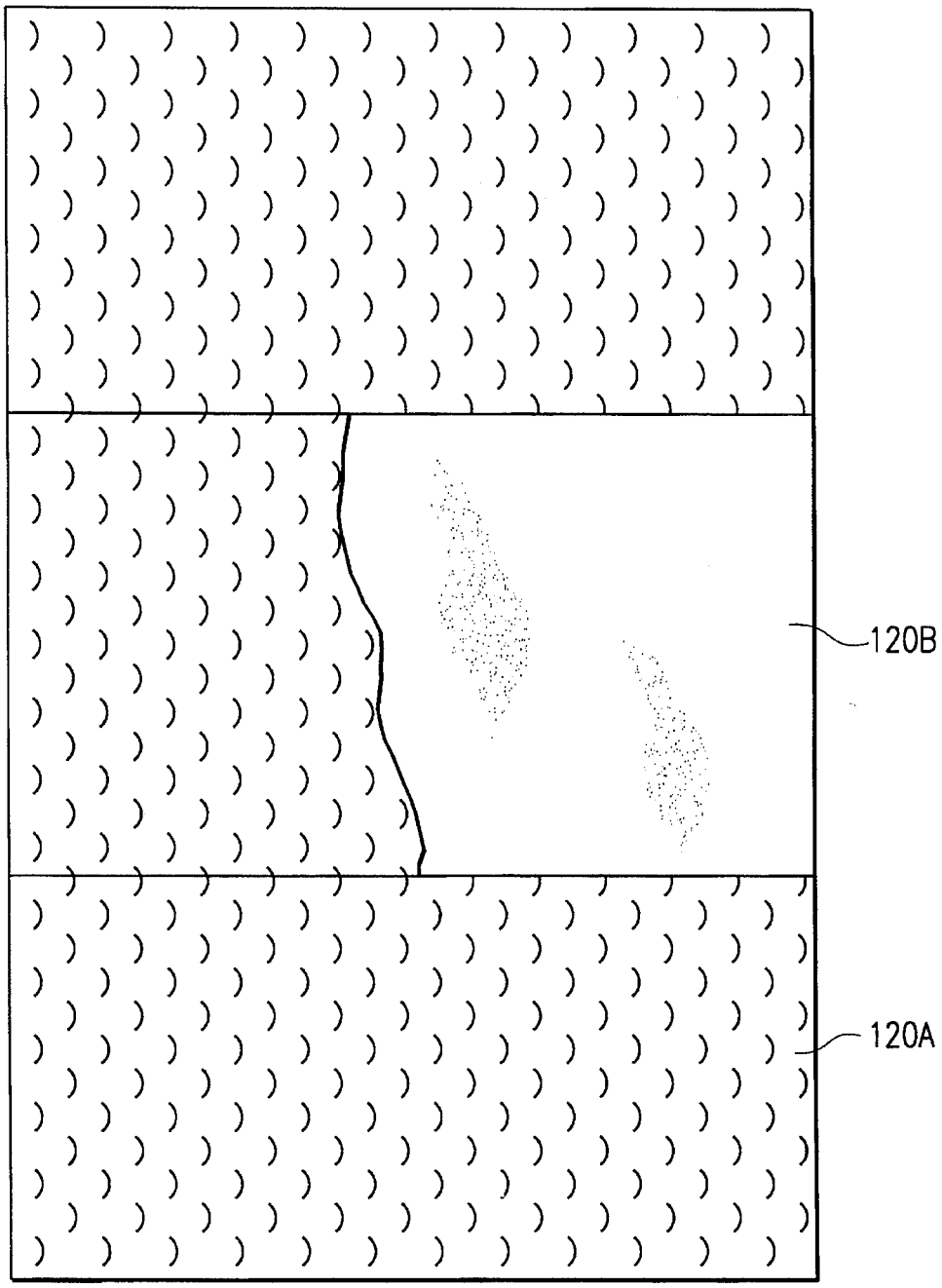
FIG. 2
FIG. 3
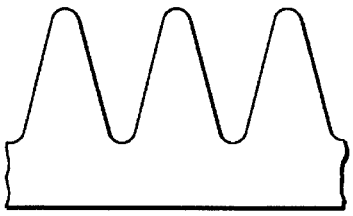

BEDDING STRUCTURE WITH QUILTED-IN LUMBAR SUPPORT

CROSS-REFERENCE TO RELATED APPLICATION

This application is a continuation-in-part claiming priority from U.S. application Ser. No. 07/958,295, filed Oct. 7, 1992 now U.S. Pat. No. 5,319,814, and entitled "Bedding Structure with Enhanced Postural Support," which is hereby incorporated by reference.

BACKGROUND AND SUMMARY OF THE INVENTION

The present invention relates to structures and materials and manufacturing methods for quilted bedding products, particularly mattresses and mattress panels.

An immense expenditure is laid out for mattresses each year. Some of this expenditure goes for air, water, or foam mattresses, but (in the United States at least) the overwhelming majority of expenditure goes for innerspring mattresses.

Some mattress technologies provide support which is inherently somewhat uniform. This is NOT true of innerspring mattresses, where different coils can be made of different stiffnesses, to modulate the hardness of the mattress as desired across the length and width of the mattress. However, many existing innerspring mattresses were manufactured without such modulation, or without an adequate amount of such support modulation. This invention provides a method of offering variable support over the surface of a mattress by a simpler (and therefore less expensive) means.

An innerspring mattress is a moderately expensive and long-lived consumer asset. (A typical price for a good-quality mattress and box-spring set, in the United States, would be in excess of $500, and the in-service lifetime of such a set would typically be more than 10 years.) Thus, purchase of complete bedding sets for all beds in a household would typically be a sizable expenditure. Consumers will be reluctant to replace old mattresses which are still serviceable.

The hardness of an innerspring mattress is affected by the gauge of the spring wire, the number of springs, and the coil design. There is no generally accepted quantitative measure of hardness or softness of innersprings, but the extreme cases can be readily identified. Thus, for example, a full-size mattress with 312 coils of 12.5 gauge spring wire in Bonnell wrap would be an unusually hard mattress. (The number of coils is usually specified with reference to the full-size mattress. For a given mattress model, this number is varied proportionately for other mattress sizes.) Mattresses with lighter-gauge spring wire, for a given number of coils, would be softer. For a given spring wire gauge, mattresses with a lower number of coils will generally be softer.

Harder innerspring mattresses provide better overall postural alignment. However, harder mattresses are more likely to create pressure points. The disclosed innovations provide a way to reconcile these choices, and to obtain the comfort benefits of a soft mattress and also the postural advantages of a hard mattress.

Uniform support presents a problem, because the weight distribution of the human body is not at all uniform. The highest concentration of mass (per unit length in the height axis) will be between the shoulder blades and the hips. The mass per unit length is generally lower at the head, and is much lower in the legs. (The weight distribution is, of course, different from person to person, depending on the person's age, height, sex, obesity, and general body type. However, the problems discussed are problems for a very large fraction of users.) Thus, if a soft mattress has a uniform thickness and support, the user's hips or buttocks will tend to sink excessively far into the mattress. This problem is exacerbated when the mattress is used by two persons sleeping together.

This deficit in support will tend to reduce the user's comfort, to a greater or lesser degree depending on the user. However, a more important effect is that this deficit in support may permit a user to sleep in a condition of postural misalignment. Spinal alignment, in a good sleeping posture, should be the same as that in a good standing posture. Thus a sleeper should be supported so that his or her spine will be laterally straight, and will be curved with no more (and no less) than normal lumber and thoracic arch and pelvic tilt. Distortions of this sleeping posture will produce immediate or gradual discomfort, and may also lead to backaches, or to vague discomforts which reduce the user's overall level of health and well-being.

Some efforts have been made to increase the support under the torso. For example, the "System 750" waterbed, from Land and Sky, includes a floating foam/fiber structure, inside the bag, which is thicker under the user's midsection to provide additional back support.

U.S. Pat. No. 5,077,848 (to McDaniel et al.) discloses an immersed tube structure, with foam inserts in the robe.

The "Avanti III" model, from Pleasant Rest, is a waterbed with a foam topping, which includes extra layers of fiber (under a single sheet of foam) under the user's midsection to provide added lumbar support.

The "Marvelous Middle" from Restonic includes stiffer springs in the middle of the mattress. The cover itself includes extra lines of stitching, under the sleeper's midsection, which give the impression that the middle of the cover is different from the rest of the cover; but in fact (insofar as is known to the present inventor) the cover is uniform over its length, and does NOT include any additional material under the sleeper's midsection. Apart from the art of waterbeds, other attempts have been made to design sleeping pads with some allowance for the uneven weight distribution of the human body. Many of these attempts have used convoluted foam, which is one of the basic structural materials used in designing bedding structures. Convoluted foam (in which one surface is carved into a rippled or egg-carton shape) is effectively softer than a solid block of foam of equivalent height, because the individual protrusions in the carved portion have more room to expand laterally under pressure. Convoluted foam is described, for instance, in U.S. Pat. No. 3,026,544 to Persicke et al., which is hereby incorporated by reference.

Some of the attempts to use convoluted foam pads for sleeping structures are shown in U.S. Pat. Nos. 4,620,337 to Williams et al.; 4,955,096 to Gilroy et al.; and 4,879,776 to Farley; all of which are hereby incorporated by reference.

INNOVATIVE BEDDING STRUCTURE

The present invention provides an improved bedding structure, in which added postural support is provided by a quilted, variable-support material used in making a mattress cover. (With modifications, the quilted variable-support material used in these padded mattress covers could also be used for postural support in chair backs, car seats, and cushions.) This innovative structure provides advantages of better postural support, and/or reduced manufacturing costs, and/or better in-service durability, and/or extra thermal insulation and padding and/or better comfort.

The padded cover includes a support structure which covers essentially the full length of the mattress. This support structure is stiffer over the middle part of the mattress length. Thus, this arrangement provides extra firmness under the torso. The support structure is quilted into the mattress cover to provide stability in use.

A particular advantage of the claimed postural support structure is that it provides variable firmness with constant thickness. Even where the starting materials are nonuniform in thickness (e.g. due to the introduction of an additional foam piece, under the lumbar area only, to provide enhanced postural support), the quilting process tends to compress the layers to uniform thickness. This is more cosmetically attractive to buyers and end-users.

In the presently preferred embodiment, the support material consists of two layers of convoluted foam: a first layer has the same width as the ticking and quilt backing material and a second layer which has a width approximately one third of the width of the other layers. These two pieces of foam are mated with convoluted sides together, with the shorter piece being in the middle portion of the wider piece (e.g. the middle third, optionally offset toward the head or foot end).

However, it is important to note that other material layers, or combinations of material layers, can alternatively be used to provide quilted-in longitudinally nonuniform postural support elements. For example, other possible support elements include variable density foam or a pre-glued composite foam. A key innovative teaching of the present application is the specific relevance of quilting to provide stability and uniform thickness for longitudinally nonuniform postural support elements in bedding.

INNOVATIVE MANUFACTURING METHODS

The disclosed innovations also provide improved methods for manufacturing bedding material with stable and longitudinally nonuniform postural support. For example, in the presently preferred embodiment, three layers are fed into a standard quilting machine: an upper layer of ticking, a (doubled) middle layer of support material, and a bottom layer of quilt backing. The support material thus is quilted between the two other layers, giving a quilted fabric that may be made into a mattress cover.

Quilting machines are one of the standard pieces of capital equipment in the bedding industry, and have long been used to assemble quilted structures which included flat foam or bulk fiber for padding. Similarly, the benefits of nonuniform support for postural support in bedding are known. However, the present application discloses an advantageous combination of these elements: quilting longitudinally nonuniform postural support element into an otherwise conventional quilted bedding structure provides an efficient and low-cost method for manufacturing durable bedding materials and bedding products which provide enhanced comfort to the end-user.

Quilting machines are one of the standard pieces of capital equipment in the bedding industry. Similarly, as discussed above, the support properties of convoluted foam for bedding have previously been discussed. However, the present application discloses an advantageous combination of these elements: quilting convoluted foam into an otherwise conventional quilted bedding structure provides an efficient and low-cost method for manufacturing bedding materials and bedding products which provide enhanced comfort to the end-user.

The thickness and firmness for the convoluted foam, and the other materials in the quilted structure (as will be obvious to those of ordinary skill in the art), the innovative convoluted foam structure can be structured to include air voids (between the points of the convoluted foam) underneath the sleeper. This provides air circulation underneath the sleeper, and thereby provides enhanced comfort.

The cover may be constructed to be easily removable, as are standard mattress pads, for use with retrofits, but is equally applicable for use in making a non-removable cover as a part of the manufacture of an innerspring mattress, an air mattress or a foam mattress. When used during the manufacturing process, the cover preferentially provides enhanced postural support, as described above, on BOTH surfaces (upper and lower) of the mattress. This permits users to readily turn over a mattress, without worrying about which side has the enhanced support.

A further related advantage of the disclosed innovations is that manufacturers can use these innovative teachings to rapidly modify existing mattress designs, which are already in production (or even in inventory), to improve the postural support at minimal cost.

A further advantage is that a mattress's postural support can be readily customized. Thus, for example, the distribution of support needed by a muscular male athlete is quite different from that needed by a fashionably thin nulliparous adult female, or an obese middle-aged person. By use of the disclosed innovations, customized versions can readily be produced, at minimal cost, as simple modifications to an existing production line.

BRIEF DESCRIPTION OF THE DRAWING

The present invention will be described with reference to the accompanying drawings, which show important sample embodiments of the invention and which are incorporated in the specification hereof by reference, wherein:

FIG. 2 is a panel of the two layers of convoluted foam as used in the preferred embodiment as the support layer;

FIG. 3 is a schematic detail view of the shape and typical dimensions of a sample convoluted foam structure.

DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

FIG. 3 is a schematic detail view of the shape and typical dimensions of a sample convoluted foam structure. The foam actually used, in the presently preferred embodiment, is an open-cell foam of polyurethane composition, of about 1 pound per cubic foot bulk density. The "ILD" parameter (indentation load deflection) is about 30, in the presently preferred embodiment. The convoluted shape used has a base thickness of ½", and an overall height of 1½". (Thus, when two pieces of foam are mated together, their overall thickness is only 2 inches.)

Figure 1:
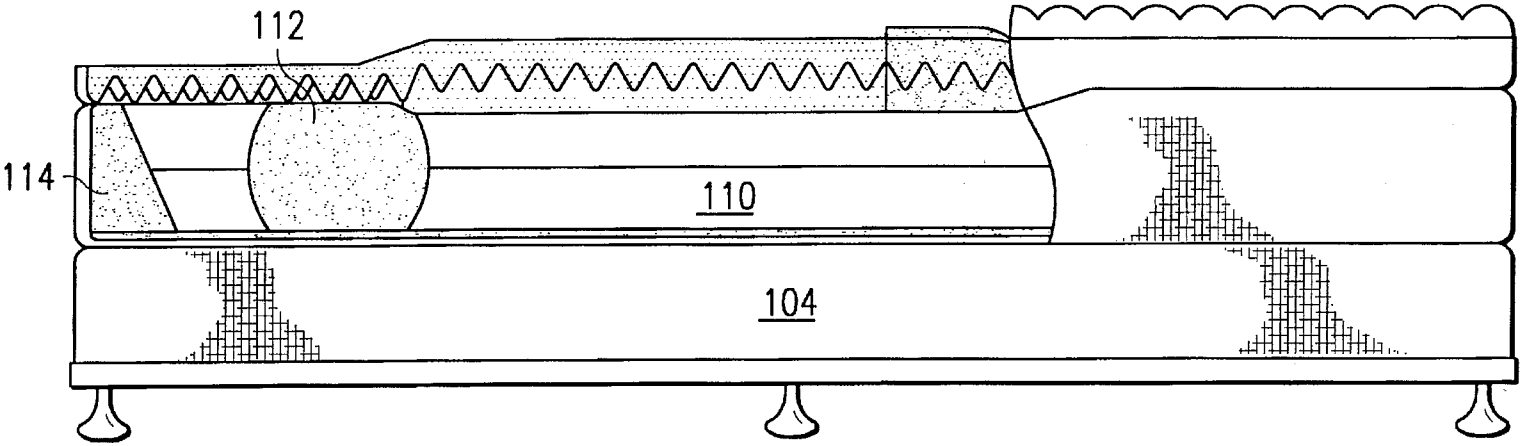
FIG. 1 is a sectional view of the mattress cover structure of the presently preferred embodiment.

FIG. 1 is a sectional view of the mattress cover structure of the presently preferred embodiment. A sheet of ticking, preferably of 100–150 end Damask, overlays a full sheet of convoluted foam. Lumbar convoluted foam covers the full width of the mattress cover, but covers only the middle third (approximately) of the length of the cover. A quilt backing provides a bottom layer. The quilt backing will be quilted to the ticking to provide stability to the foam sheets. In the presently preferred embodiment, the quilt backing is made of a non-woven fabric, e.g. Accord™ or Vantex™ of 0.5 to 1.5 ounce weight.

Of course, the foregoing specific materials and weights are merely illustrative. As will be apparent to those of ordinary skill in the art, other materials, such as knit, chintz, or others can readily be substituted.

Figure 4:
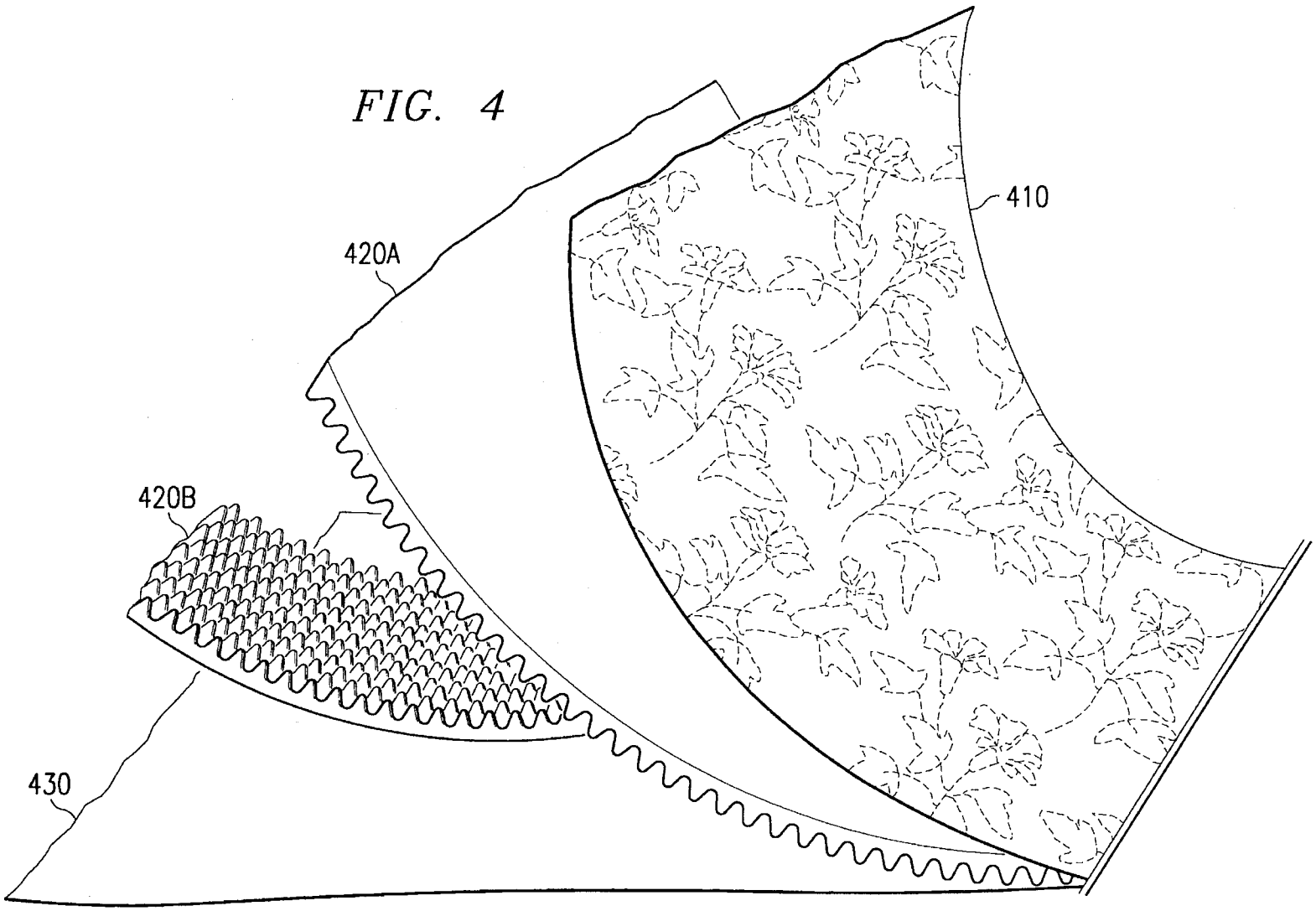
FIG. 4 schematically shows the flow of materials as they would be fed from rolls into a quilting machine in a sample embodiment.

FIG. 4 shows the three layers to be quilted (the support layer here is two separate pieces of convoluted foam which align in a mated, interlocked position as they are being fed into the quilting machine.) The materials, as they are fed into the quilting machine, are oriented such that the outer edges of the finished material will be the "head" and "foot" of the finished product, i.e., the finished product will have gone through the quilter sideways. The preferred method for doing the quilting is with a GI-4300-WCS class III computer driven double lock chain stitch quilter, made by Gribetz International, Inc., Sunrise, Fla.

In a sample embodiment, the top thread would be 3-ply, 150 denier polyester, 475 total denier; the bottom thread would be 2-ply, 150 denier polyester, 340 total denier; needle gauge would be #24 with a stitch size of 6–9 per inch. For durability and comfort, the distance between lines of stitching in the pattern would preferably be a maximum of approximately 8 inches, but of course this parameter can be varied. (Narrower spacing will tend to provide firmer support, and wider spacings will provide a softer, more plush surface.)

Figure 5:
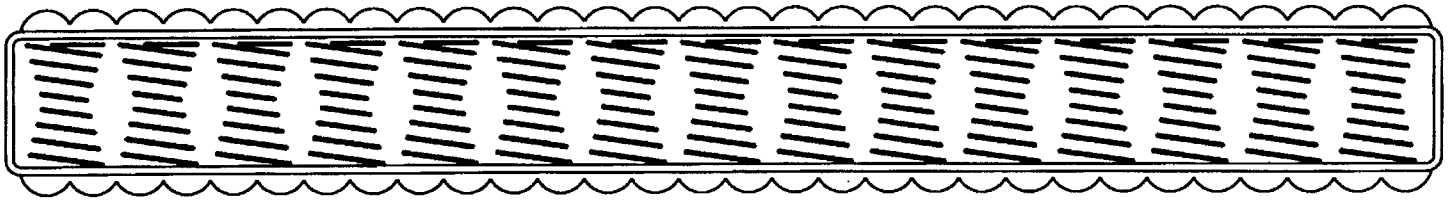
FIG. 5 is a cutaway view of a sample embodiment of an innerspring mattress enclosed in a cover which has enhanced postural support on both upper and lower surfaces of the mattress.

Once the quilting has been done, the resulting quilted, variable-support material is fed into a panel cutting machine, such as the OCS-90, by Gribetz, where panels of appropriate lengths (widths of finished products) are cut. These panels may then be used in the manufacture of innerspring mattresses, or they may be used to make removable mattress pads and covers FIG. 5 shows a cutaway view of an innerspring mattress where the frame and springs are covered by a panel of quilted, variable-support material.

Sleepers of different heights will typically align themselves to the head end of the mattress, and the following sample dimensions take account of this. However, of course, these dimensions can be made symmetrical (so that head-foot reversal will not affect them), or otherwise altered in a variety of ways.

For example, for a king-size mattress, the dimensions of the elements described above, in the presently preferred embodiment, are:

top foam padding piece: 76" wide by 80" long;
bottom foam padding piece: 76" wide by 26" long.

Thus, the unsupported length of the top piece at the head end is 23 inches, and the unsupported length of the top piece at the foot end is 31 inches.

FURTHER MODIFICATIONS AND VARIATIONS

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but these examples do not nearly exhaust the full scope of variations in the disclosed novel concepts.

For example, it is alternatively possible to scallop foam sheets in place, at the input to the quilter.

For example, the quilted, variable support material made by this process is preferentially used in the manufacture of mattress panels and covers, but it can also be used, alternatively and less preferably, for other products which provide postural support.

For another example, other combinations of materials, such as two flat foam pieces of unequal width, can alternatively be used to provide a longitudinally nonuniform postural support element.

For another example, the cover may be fiat to lay atop a mattress, it may have an elasticized "skirt" to hold it removably in place over an innerspring mattress, or it may be built into the cover of a new innerspring mattress to be non-removable.

For another example: the convoluted foam is in an egg-carton pattern, in the presently preferred embodiment. However, a ripple pattern, or another self-complementary pattern, or a pair of different but complementary patterns, could alternatively be used instead.

Of course, the dimensions and material compositions of the presently preferred embodiment have been specified merely for full compliance with the best mode requirements, and can be widely modified and varied.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A quilted material comprising:

a ticking material, a support material, comprising convoluted foam, wherein the degree of firmness provided by said support material differs along at least one direction, and a backing material;

said ticking material, said support material and said backing material all being quilted together by stitching.

2. The quilted material of claim 1, wherein said support material comprises a first polymer foam pad, having at least one convoluted surface;

a second polymer foam pad, having at least one convoluted surface, said second polymer foam pad having approximately one-third the length of said first polymer foam pad;

said first and second foam pads being mated together with respective convoluted surfaces thereof facing together and with said second polymer foam pad aligned with the approximate middle third of the length of said first second polymer foam pad.

3. The quilted material of claim 2 wherein said convoluted surface of said first foam pad and said convoluted surface of said second foam pad are both convoluted with an egg-carton pattern.

4. The quilted material of claim 2 wherein said first foam pad consists essentially of a polymer foam having an ILD measurement of at least 25.

5. The quilted material of claim 2 wherein said first foam pad has a bulk density of about 1 pound per cubic foot.

6. A quilted material comprising:

a ticking material, first and second bulk support materials, each of said bulk support materials comprising convoluted foam, said first material being in a width which is substantially greater than said second material;

a backing material;

said ticking material, said support material and said backing material all being quilted together by stitching.

7. The quilted material of claim 6, wherein said first bulk support material comprises a first polymer foam, having at least one convoluted surface;

and wherein said second bulk support material comprises a second polymer foam, having at least one convoluted surface, said second polymer foam having approximately one-third the width of said first polymer foam;

said first and second polymer foams being mated together with respective convoluted surfaces thereof facing together and with said second polymer foam aligned with the approximate middle third of the width of said first second polymer foam.

8. The quilted material of claim 7 wherein said convoluted surface of said first foam pad and said convoluted surface of said second foam pad are both convoluted with an egg-carton pattern.

9. The quilted material of claim 7 wherein said first foam pad consists essentially of a polymer foam having an ILD measurement of at least 25.

10. The quilted material of claim 7 wherein said first foam pad has a bulk density of about 1 pound per cubic foot.

11. A bedding structure comprising a combination of a quilt backing having a substantially rectangular top surface of substantially predetermined width and length;

a support structure comprising convoluted foam and having one horizontal dimension at least equal to 80% of said predetermined length;

a ticking having substantially the same shape as said quilt backing, wherein said support structure is placed between said quilt backing and said ticking and said combination is quilted together.

12. The bedding structure of claim 11, further comprising an elasticized skirt of material which is attached to the periphery of said combination.

13. A quilted material comprising:

a ticking material, one or two layers of convoluted foam, and a backing material;

said ticking material, said layers of convoluted foam and said backing material all being quilted together by stitching.

14. The quilted material of claim 13 wherein said convoluted foam is convoluted with an egg-carton pattern.

15. The quilted material of claim 13 wherein said convoluted foam consists essentially of a polymer foam having an ILD measurement of at least 25.

16. The quilted material of claim 13 wherein said convoluted foam has a bulk density of about 1 pound per cubic foot.

17. A bedding structure comprising a combination of a quilt backing having a substantially rectangular top surface of substantially predetermined width and length;

one or two layers of convoluted foam having one horizontal dimension at least equal to 80% of said predetermined length;

a ticking having substantially the same shape as said quilt backing, wherein said layers of convoluted foam are placed between said quilt backing and said ticking and said combination is quilted together.

18. The quilted material of claim 17 wherein said convoluted foam is convoluted with an egg-carton pattern.

19. The quilted material of claim 17 wherein said convoluted foam consists essentially of a polymer foam having an ILD measurement of at least 25.

20. The quilted material of claim 17 wherein said convoluted foam has a bulk density of about 1 pound per cubic foot.

* * * * *